United States Patent [19]

Glaser

[11] 4,176,856

[45] Dec. 4, 1979

[54] BINDING FOR CROSS-COUNTRY SKIS

[76] Inventor: Hans E. Glaser, Ringstrasse 9, D-8591 Wiesau, Fed. Rep. of Germany

[21] Appl. No.: 923,694

[22] Filed: Jul. 11, 1978

[30] Foreign Application Priority Data

Feb. 25, 1978 [DE] Fed. Rep. of Germany ..... 2808131

[51] Int. Cl.[2] ..... A63C 11/12

[52] U.S. Cl. ..... 280/611; 280/615; 280/636; 280/11.37 E

[58] Field of Search ..... 280/615, 614, 636, 11.37 E, 280/11.37 R, 607, 619, 621, 611, 11.37 G, 11.37 J, 622

[56] References Cited

U.S. PATENT DOCUMENTS

| | | | |
|---|---|---|---|
| 3,953,042 | 4/1976 | Pyzel et al. | 280/631 |
| 4,116,462 | 9/1978 | Buel | 280/636 |

FOREIGN PATENT DOCUMENTS

| | | | |
|---|---|---|---|
| 1119264 | 6/1956 | France | 280/619 |
| 350596 | 7/1937 | Italy | 280/611 |
| 84811 | 11/1954 | Norway | 280/607 |
| 157065 | 9/1932 | Switzerland | 280/611 |

*Primary Examiner*—David M. Mitchell

*Attorney, Agent, or Firm*—Brady, O'Boyle & Gates

[57] ABSTRACT

Auxiliary binding for cross-country skis, comprising a clasp adapted to be fitted to a ski boot, a plate adapted to be fitted to the ski and having two upstanding prongs defining between them a recess having a width which decreases towards the plate, a wedge attached to the clasp and arranged to lodge in said recess in the standing or starting position, a rounded protuberance on the clasp adapted to fit into a corresponding groove formed in the heel of the boot, and a bore in the clasp for receiving a screw to attach the clasp to the heel of the boot.

5 Claims, 3 Drawing Figures

BINDING FOR CROSS-COUNTRY SKIS

BACKGROUND OF THE INVENTION

The invention relates to an auxiliary binding for cross-country skis which is distinguished by great reliability and safe method of operation, An auxiliary binding for cross-country skis in which a wedge secured to the heel of the boot is inserted with ever decreasing clearance into prongs, which are secured to the ski and open out upwardly, on changing from the cross-country position to the standing downhill position has already been proposed.

The auxiliary bindings manufactured heretofore according to these measures cannot cope with the highest stresses. Neither the clasps with the wedges fastened to the heels of the conventional cross-country boots nor the supporting plate with the guide prongs fastened to the ski behind the heel of the boot are reliable enough.

It is the aim of the invention to avoid these disadvantages of the lighter construction of auxiliary bindings used for cross-country skis heretofore.

SUMMARY OF THE INVENTION

According to the invention this aim is achieved in that the clasp with the wedge has an inwardly projecting bulge of semicircular cross-section which fits flush with the groove in the heels of the cross-country ski boots and has, on each end, a perforation or hole therethrough extending in the direction of the ski, each perforation being widened for the reception of a screw. The plate with the prongs is under the heel of the boot. An elastic disc which is curved upwardly is embedded at the centre of said plate.

On the heel support the inwardly projecting bulge fills the groove on the heels and provides the clasp with a maximum supporting surface and thus, a firm grip on the heel of the boot. One screw on the opposite ends of the clasp is sufficient and the clasp greatly protects the strength of the boot against impairment caused by screws.

Because of the plate under the heel of the boot the transmission of force, starting from the heel by way of the prongs and heel plate to the ski is increased when the wedge engages between the prongs.

In interplay with the wedge, the prongs which have been improved in their shape and raised as shown in the drawings provide the cross-country ski with increased assistance for guiding and starting and always permit complete freedom for the heels which is indispensable for cross-country skiing.

The two elastic discs imbedded in the heel plate have two functions. First, a hard step of the heel on the ski is prevented and an elastic effect is attained upon push-off from the ski. Second, the disc has been found to be snow-repellent and the unpleasant clod formation is thus prevented.

BRIEF DESCRIPTION OF THE DRAWINGS

The invention will now be described in more detail, by way of example only, with reference to the accompanying drawings, in which.

DESCRIPTION OF THE PREFERRED EMBODIMENT

Figure 1:
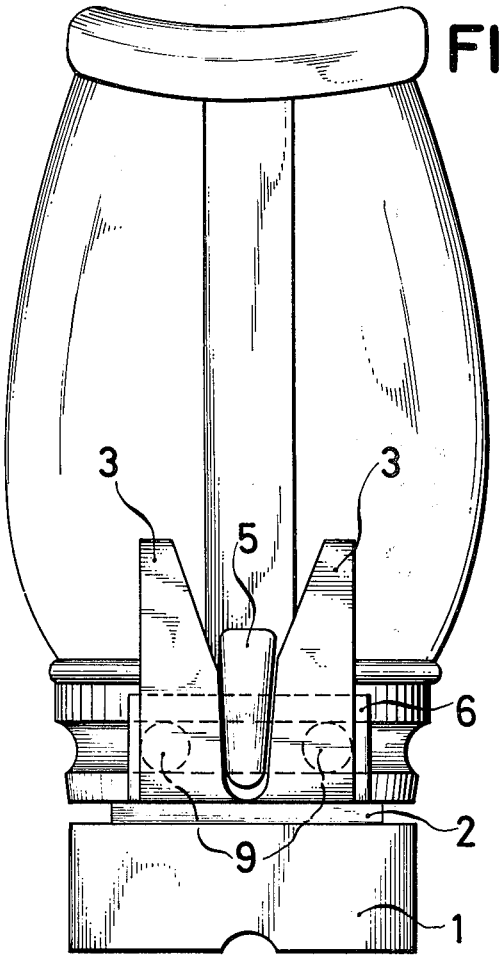
FIG. 1 is a rear view showing a substantial portion of the ski with the auxiliary binding according to the invention with the boot in the standing or downhill position.
Figure 2:
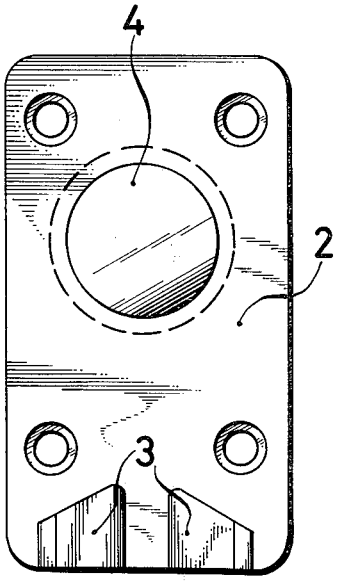
FIG. 2 is a top plan view of the plate with the upstanding prongs.
Figure 3:
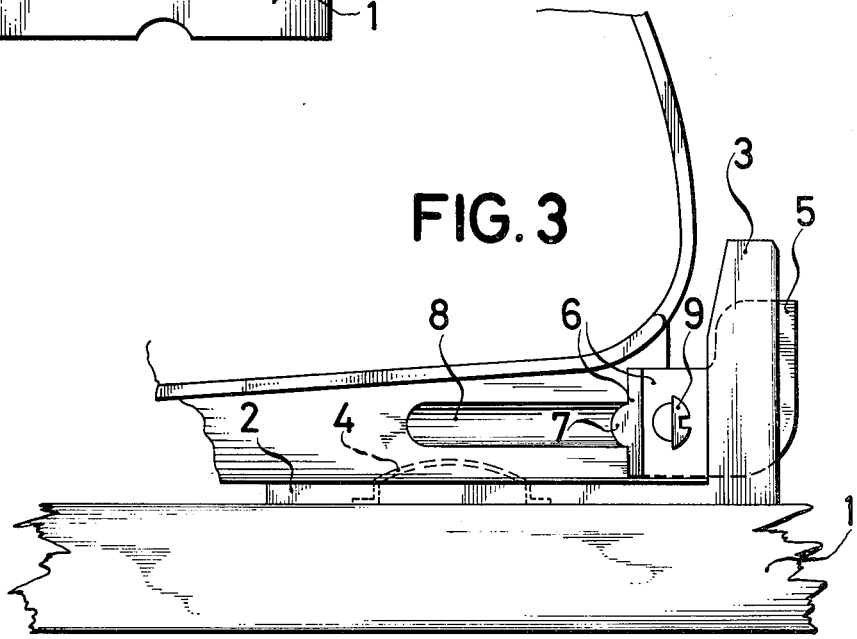
FIG. 3 is a side elevation view showing a fragmentary portion of the ski and boot with the auxiliary binding according to the invention.

In the drawings, a plate 2, which has prongs 3 with the spacing therebetween increasing upwardly on its rearward end, and an upwardly curved, flexible disc 4, on a medial portion, is screwed to the upper surface of a ski 1. As shown, the prongs 3 have substantial thickness longitudinally of the ski and particularly in the wedge gripping area.

A curved clasp 6 is adapted to fit snugly to the heel of the ski boot. A rounded protuberance 7 of semi-circular cross-section projects from the leading edge of the clasp 6 and, in the downhill position, fits into a horizontal groove 8 formed in the side wall of the heel of the boot.

A borehole, extending parallel to the ski, is formed at each side of the clasp 6. A screw 9 extends through the boreholes and firmly attaches the clasp 6 to the heel of the ski boot. A wedge portion 5 extends rearwardly from the clasp, and is provided with downwardly converging side walls corresponding to the spacing between and the taper of the upwardly diverging opposed inner edges of the prongs 3 that define the mating groove for the wedge 5 therebetween. The prongs 3 have substantial height, extending well above the level of the heel of the ski boot when in use. The upwardly diverging opposed inner edge of the prongs 3, at the upper portions of the prongs diverge at a substantially greater angle than at the lower portions which define the gripping portion for the wedge 5. The wide upwardly diverging upper portion of the groove thus formed between the prongs defines a guide for ease of guidance of the wedge 5 down into the lower wedge gripping portion of the groove.

In use, the wedge 5 may be lifted freely out of the groove between the prongs 3 when the skier walks in the cross-country mode. However, when a downhill slope is encountered, the skier firmly digs his heels into the ski and the wedge 5 is lodged in the recess between the prongs 3. This securely attaches his heel to the ski by the wedging action between wedge 5 and prongs 3 and enables him to have good control over his skis during the downhill run. When the downhill run is over, and the skier reverts to the cross-country mode, wedge 5 simple lifts out from between the prongs 3 and the skier continues in the usual manner.

The embodiments of the invention in which an exclusive property or privilege is claimed are defined as follows:

1. An auxiliary binding for cross-country skis, comprising a clasp secured to the side wall of the heel of a ski boot, said clasp having a rounded protuberance positioned in a corresponding groove formed in the heel of the boot, a wedge portion connected to said clasp and extending rearwardly therefrom, said wedge having downwardly converging side walls, a plate secured to the ski, two upstanding prongs integrally connected to one end of said plate, said prongs having upwardly diverging opposed inner edges defining a recess having a width which decreases towards the plate, the upwardly diverging opposed inner edges of the prongs at the upper portions thereof diverging at a substantially greater angle than at the lower portions, said lower portions diverging at an angle corresponding to the downwardly converging side walls of said wedge, whereby the wide upwardly diverging upper portion of the recess provides a guide to facilitate the insertion of the wedge into the lower wedge gripping portion of the recess.

2. An auxiliary binding for cross-country skis, according to claim 1, wherein said plate extends under the heel of the ski boot, and a convexly curved resilient disc mounted in the plate and being positioned under the heel of the ski boot.

3. An auxiliary binding for cross-country skis, according to claim 1, wherein the surfaces of the prongs facing in the direction of the clasp diverge outwardly relative thereto.

4. An auxiliary binding for cross-country skis, according to claim 1, wherein the clasp is secured to the side wall of the heel by means of at least one screw extending through a bore in the clasp extending parallel to the longitudinal axis of the ski.

5. An auxiliary binding for cross-country skis, according to claim 1, wherein the bottom edge of the wedge is adjacent the plane of the bottom surface of the heel, and the upper edge of the wedge is positioned above the top of the heel.

* * * * *